United States Patent [19]

Rikiishi

[11] Patent Number: 5,063,756

[45] Date of Patent: Nov. 12, 1991

[54] ELASTIC YARN FEEDING DEVICE

[75] Inventor: Tsutomu Rikiishi, Bunsui, Japan

[73] Assignee: Nagata Seiki Kabushiki Kaisha, Tokyo, Japan

[21] Appl. No.: 465,070

[22] Filed: Jan. 30, 1990

[30] Foreign Application Priority Data

Jun. 2, 1988 [JP] Japan ..... 63-73646

[51] Int. Cl.[5] ..... D04B 15/50

[52] U.S. Cl. ..... 66/132 R; 226/35

[58] Field of Search ..... 66/132 R, 132 T; 226/35; 242/47

[56] References Cited

U.S. PATENT DOCUMENTS

| | | | |
|---|---|---|---|
| 2,293,838 | 8/1942 | Lawson | 66/132 R |
| 4,571,958 | 2/1986 | Güell | 66/132 R |
| 4,625,528 | 12/1986 | Güell | 66/132 T |
| 4,969,339 | 11/1990 | Vincoli | 66/132 R |

FOREIGN PATENT DOCUMENTS

| | | | |
|---|---|---|---|
| 7663 | 12/1955 | Fed. Rep. of Germany | 66/132 R |

*Primary Examiner*—Wm. Carter Reynolds

*Attorney, Agent, or Firm*—Ladas & Parry

[57] ABSTRACT

In an elastic yarn feeding device of a multi-yarn feeding circular knitting machine, a rotary drive shaft (18) is horizontally arranged above a circular horizontally rotary plate (6), and the drive shaft (18) is provided with a drive roller (17) to be slidable in a longitudinal direction of the drive shaft. The drive roller (17) is urged against the upper surface of the rotary plate (6). When the rotary plate (6) is driven to rotate, the drive roller (17) is also rotated together with the rotary plate. Both the drive roller (17) and the drive shaft (18) are varied in rotational speed by moving the drive roller in the radial direction of the rotary plate (6). The drive shaft (18) has a plurality of feed rollers (21*a*, 21*b*, 21*c*, 21*d*) secured to it, and pinch rollers (26*a*, 26*b*, 26*c*, 26*d*) are elastically pressed against these feed rollers, respectively. Elastic yarn (Y) is fed through between each pair of the feed roller and the pinch roller. When the drive roller (17) are moved in a radial direction of the rotary plate (6), the whole pairs of the feed rollers and the pinch rollers are simultaneously changed in yarn feeding speed. Every pinch roller is movable away from the feed roller against the resiliency of the spring (25) when desired, and thus feeding of any elastic yarns may be stopped. The number of the elastic yarn Y to be fed depends upon the number of pairs of the feed rollers and the pinch rollers.

4 Claims, 3 Drawing Sheets

ELASTIC YARN FEEDING DEVICE

TECHNICAL FIELD

The present invention relates to an elastic yarn feeding device for multi-yarn feeding circular knitting machine used for knitting stretchable knitted goods such as hose and body suits, for example.

BACKGROUND ART

One example of known elastic yarn feeding devices of the circular knitting machine is disclosed in Japanese Utility Model Examined Publication No. 59(1984)-2051. In the elastic yarn feeding device disclosed in this publication, a feed roller is urged against the upper surface of a horizontal rotary plate which is driven by a drive, and the feed roller is rotated by the rotation of the rotary plate. An elastic yarn (rubber yarn) is passed between the rotary plate and the feed roller so as to be held between them, and the elastic yarn is fed to the circular knitting machine by the rotation of the feed roller. The feed speed of the elastic yarn is changed by moving the feed roller in a radial direction of the rotary plate. As the feed roller is moved radially outwardly of the rotary plate, the circumferential speed of the rotary plate is increased and hence so does the rotational speed of the feed roller.

This known elastic yarn feeding device can feed only one elastic yarn and cannot be used without modification for a multi-yarn feeding device which is used for knitting stretchable knitted products such as body suits and hose. Moreover, use of this elastic yarn feeding device to feed elastic yarns requires a plurality of such elastic yarn feeding devices, and thus the whole system involves problems such that it becomes large sized, and requires a large occupying area and complicated rigging.

It is an object of the present invention to provide an elastic yarn feeding device suitable for multi-yarn feeding circular knitting machines. The elastic yarn feeding device is capable of feeding elastic yarns simultaneously and at the same speed and is small in overall size with a simple structure. In addition, the elastic yarn feeding device is capable of stopping the feeding of any one of the elastic yarns.

DISCLOSURE OF THE INVENTION

This object is achieved by an elastic yarn feeding device which includes a rotary plate, means for rotating the rotary plate, a drive roller pressed against the rotary plate and adapted for rotation in the tangential direction of the rotary plate by rotation of the rotary plate, means for displacing the drive roller in a radial direction of the rotary plate to vary the revolution of the drive roller, and means for feeding an elastic yarn by the rotation of the drive roller, the elastic yarn feeding device comprising: a drive shaft being rotatable together with the drive roller, supporting the drive roller to be axially movable and passing through a center axis of the rotary plate to extend in parallel with the surface of the rotary plate; a plurality of feed rollers secured to the drive shaft at intervals; pinch rollers equal in number to the feed rollers and resiliently pressed against respective feed rollers; and elastic yarn feeding means for feeding the elastic yarn in a state held between each pair of the feed roller and the pinch roller.

BEST MODE FOR CARRYING OUT THE INVENTION

Before describing the embodiment of the present invention, the known elastic yarn feeding device above mentioned will be explained.

Figure 5:
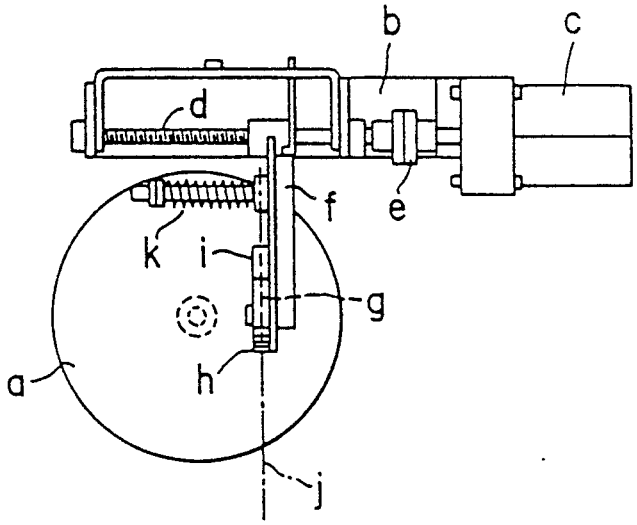
FIG. 5 PRIOR ART
FIG. 5 is a plan view of a conventional elastic yarn feeding device.

The conventional elastic yarn feeding device previously described is constructed as shown in FIG. 5. That is, in FIG. 5 a rotary plate a is horizontally rotatably supported on a frame (not shown). A frame b just above the rotary plate a is provided with a reversible motor c, of which output shaft is connected to a feed screw d through a joint e. A feed arm f is threaded to this feed screw d for horizontal movement. A feee end of this feed arm f has a feed roller g rotatably mounted to it in such a manner that the feed roller g contacts an upper surface of the rotary plate a, and that it is movable toward the center of the rotary plate a. The feed roller g also serves as a pinch roller. A cover i with a yarn guide h is provided to cover the outside of this feed roller g. A tension adjuster k for elastic yarn (rubber yarn) j is provided at an intermediate portion of the feed arm f, and the elastic yarn j is held between the rotary plate 1 and the feed roller g and extends from the tension adjuster k to the yarn guide h.

Thus, in the elastic yarn feeding device above described the feed screw d is rotated by energizing the motor c, so that the feed arm f which is threaded to the feed screw d is moved to a position in the rotary plate a having a predetermined rotational peripheral speed (elastic yarn feeding speed).

When the rotrary plate a is rotated, the elastic yarn j which is held between the rotary plate a and the feed roller g and extends over the yarn guide h is fed to a knitting machine at a desired speed by cooperation of the rotary plate a and the feed roller g.

That is, the feeding speed of the feed roller g is adjusted by using a change in circumferential speed of the rotary plate a, and thereby the feed of the elastic yarn j is adjusted to knit a body of a hose, for example, of the elastic yarn j.

The elastic yarn feeding device theoretically effectively feeds the elastic yarn j to a knitting machine since the elastic yarn j which is stretched to the yarn guide h by clamping between the rotary plate a and the feed roller g, also serving as a pinch roller, is fed to a knitting machine by cooperation between the rotary plate a and the feed roller g. However, the elastic yarn feeding device is constructed in such a manner that the feed speed of the feed roller g is adjusted by utilizing a change in circumferential speed of the rotary plate a and through the elastic yarn j, and hence the adjustment is carried out with the elastic yarn j held between the rotary plate a and the feed roller g. Thus, it is practically difficult to adjust the feed speed of the feed roller with the elastic yarn j kept under uniform tension.

Particularly, this elastic yarn feeding device is capable of feeding only one elastic yarn. It is therefore difficult to use this device without any modification in a multi-yarn feeding circular knitting machine for knitting stretchable knitted goods such as body suits. When a plurality of elastic yarns are fed by utilizing elastic yarn feeding devices above described, the whole system becomes large in size and imposes restriction to the place of installation. Furthermore, there are disadvantages such as an increase in the number of components and complication of assembly and adjustment.

The present invention is capable of solving the problems above described.

Figure 1:
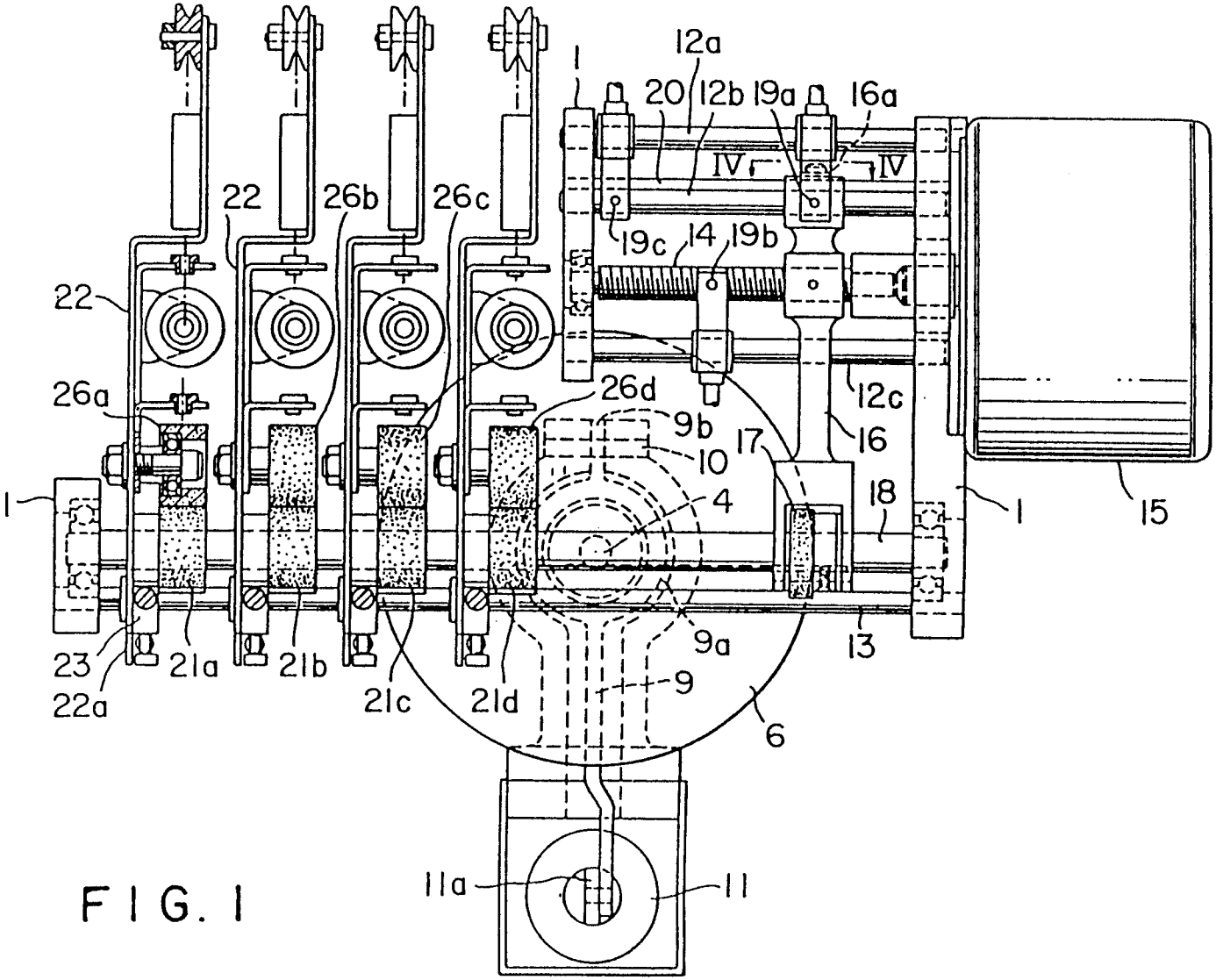
FIG. 1 is a plan view of an elastic yarn feeding device of the present invention.
Figure 2:
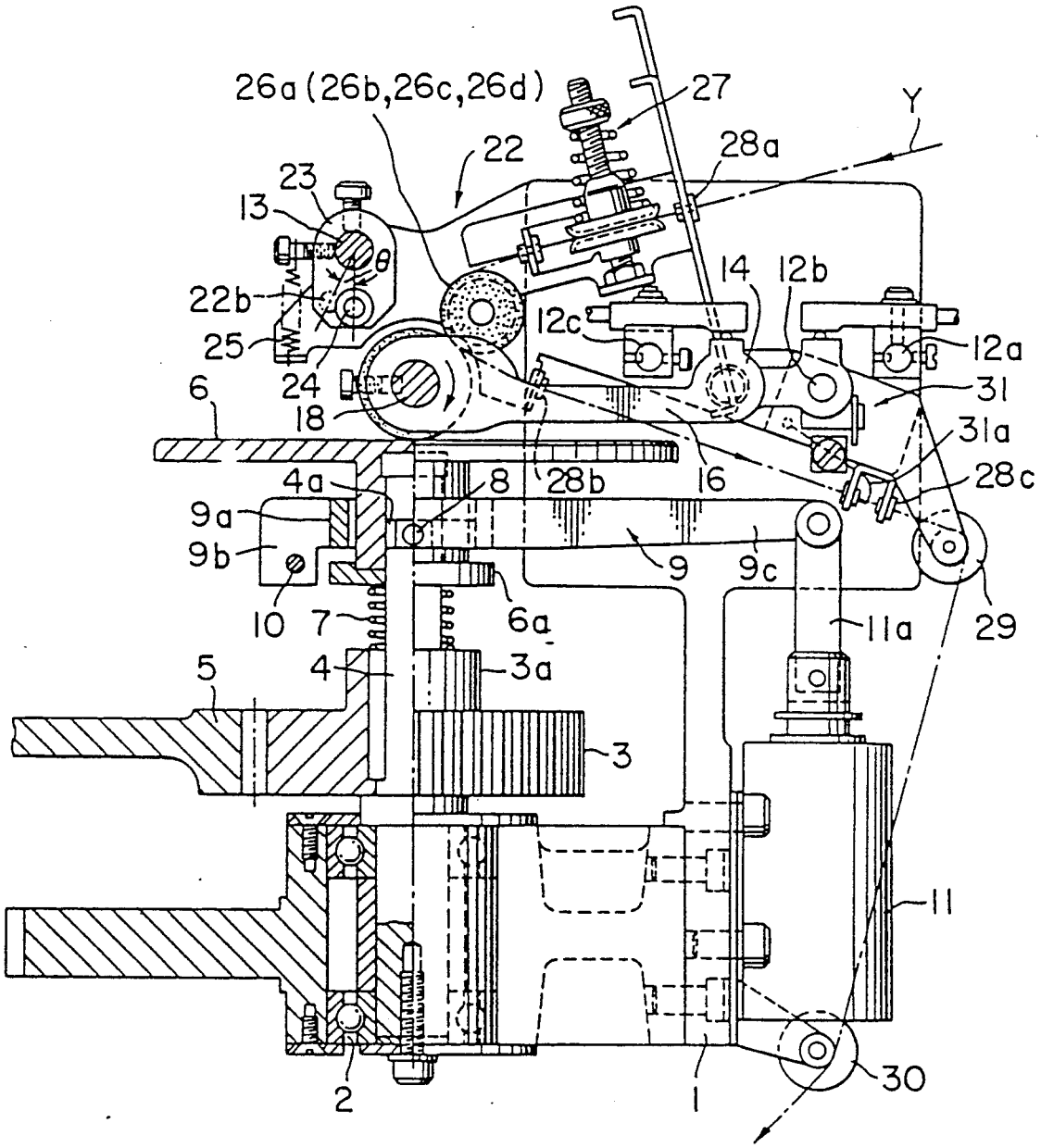
FIG. 2 is a side view, partly in section, of the device in FIG. 1.

In FIGS. 1 and 2, reference numeral 1 indicates a frame of a knitting machine such as a multi-yarn feeding circular knitting machine which knits body suits and stretchable knitted goods, for example. A rotary shaft 4 with a gear 3 is, as shown in FIG. 2, rotatably supported on a bearing 2 mounted to a lower portion of the frame 1. A large gear 5 which meshes with the gear 3 is arranged to be driven by a drive not shown. The rotary shaft 4 has a circumferential groove 4*a* formed in its upper portion. Fitted around the upper portion of the rotary shaft 4 is a boss portion of a rotary plate 6 having a flange 6*a* at its lower portion. The rotary plate 6 has a circular shape and is horizontal. A coil spring 7 is provided between a boss portion 3*a* of the gear 3 and the flange 6*a* so as to bias the rotary plate 6 to be raised. A pair of locking pins 8 which pass through the rotary plate 6 engage into the circumferential groove 4*a* so that the rotary plate 6 may not move out upwards.

A depressing lever 9 which has a ring portion 9*a* surrounding a boss portion of the rotary plate 6 is pivotally connected at its proximal portion 9*b* to a portion of the frame 1 by a pivot 10, the flange 6*a* being positioned at the portion of the frame 1. A free end 9*c* of this depressing lever 9 is connected to an output shaft 11*a* of a solenoid 11 secured to the frame 1.

Horizontally mounted in parallel with each other to a portion of the frame 1 just above the rotary plate 6 are a supporting shaft 13 and guide rails 12*a*, 12*b* and 12*c*, the guide rails also serving as supporting levers. A feed screw 14 is horizontally rotatably mounted to a portion of the frame 1 between the guide rails 12*b* and 12*c* to be parallel with the guide rail 12*b*. A driving motor 15 such as a pulse motor is connected to one end of this feed screw 14 through a coupling. A feed arm 16 is threaded to the feed screw 14. The feed arm 16 is slidably fitted around the guide rails 12*b* and 12*c*. A drive roller 17 is provided to one end of this feed arm 16 so as to contact the upper surface of the rotary plate 6. A driving shaft 18 is rotatably mounted to a portion of the frame 1 in the vicinity of the supporting shaft 13 to be parallel with the feed screw 14. The drive roller 17 is coaxially placed around the drive shaft 18 to rotate together with the drive shaft 18 to be axially slidable.

Figure 4:
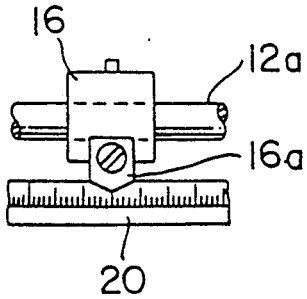
FIG. 4 is a view taken along the line IV—IV in FIG. 1.

A first proximity switch 19*a*, second proximity switch 19*b* and third proximity switch 19*c* are provided to a structural portion composed of the guide rails 12*a*, 12*b* and 12*c* so that they are aligned to the outer peripheral portion, radially central portion, and a center portion (axial center portion) of the rotary plate 6. These first proximity switch 19*a*, second proximity switch 19*b* and third proximity switch 19*c* are adapted to detect the movement of the feed arm 16 as described hereinafter. The feed arm 16 is as shown in FIG. 4 provided at its one end with an indicator 16*a*. A scale 20 is secured to a portion of the frame 1 along the traveling path of the indicator 16*a*.

Figure 3:
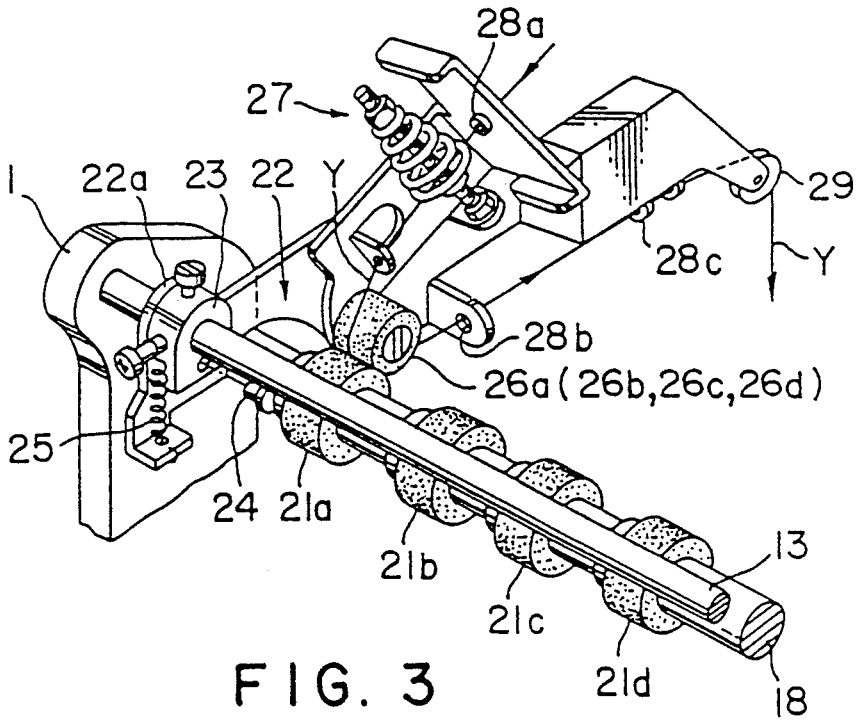
FIG. 3 is a perspective view of part of the elastic yarn feeding device of the present invention.

As illustrated in FIG. 1, a plurality of (four in the figure) feed rollers 21*a*, 21*b*, 21*c* and 21*d* are mounted around the drive shaft 18 at predetermined axial intervals. Each of yarn guide frames 22 are loosely fitted at its proximal portion 22*a* around the supporting shaft 13 in the vicinity of these feed rollers 21*a*, 21*b*, 21*c* and 21*d*. A locking member 23 is rotatably attached to the supporting shaft 13 at a position where the proximal portion 22*a* of each yarn guide frame 22 is located. A locking pin 24, shown in FIG. 3, is provided to each locking member 23 in such a manner that it detachably engages with an engaging hole 22*b* (see FIG. 2) formed in the proximal portion 22*a* with a shift angle $\theta$.

A coil spring 25 is stretched between a machine screw, screwed to each locking member 23, and the proximal portion 22*a*. The coil springs 25 are provided so as to exert forces to urge pinch rollers 26*a*, 26*b*, 26*c* and 26*d* against corresponding feed rollers 21*a*, 21*b*, 21*c* and 21*d*. The pinch rollers 26*a*, 26*b*, 26*c* and 26*d* are rotatably mounted to middle portions of corresponding yarn guide frames 22 in such a manner that they each hold an elastic yarn Y against corresponding feed rollers 21*a*, 21*b*, 21*c* and 21*d* by elastic forces of respective coil springs 25.

Each of yarn guide frames 22 is provided with conventional tension unit 27, yarn guides 28*a*, 28*b* and 28*c* to guide the elastic yarn Y. Guide rollers 29 and 30 are provided to the frame 1 in the vicinity of the yarn guide 28*c*. The elastic yarn Y is fed to a knitting machine cylinder (not shown) of the multi-yarn feeding circular knitting machine through corresponding tension unit 27, yarn guides 28*a*, 28*b*, 28*c* and guide rollers 29 and 30. A yarn detector 31 is supported on each yarn guide frame 22 in the vicinity of the yarn guide 28*c*. A detecting element 31*a* of the yarn detector 31 extends to a yarn passage of the yarn guide 28*c* to detect breakage of the yarn.

The function of the present invention will be described below.

In operating the multi-yarn feeding circular knitting machine, the rotary plate 6 is rotated by the gear 3 which always meshes with the large drive gear 5, and thus the drive roller 17 which is in contact with the rotary plate 6 is also rotated. To stop rotation of the drive roller 17, the solenoid 11 is energized to thereby actuate the depressing lever 9 by using the pivot 10 as a fulcrum, causing the flange 6*a* to be depressed against the elastic force of the coil spring 7. Thus, the rotary plate 6 is lowered to separate from the drive roller 17, so that the rotation by the drive roller 7 is discontinued.

The feed screw 14 which is coupled to the output shaft of the drive motor 15 is rotated by previously energizing the drive motor 15. Thus, the feed arm 16 which is threaded to this fed screw 14 is moved sidewardly in FIG. 1, thereby activating one of the first proximity switch 19*a*, second proximity switch 19*b* and third proximity switch 19*c*. Thus, the contact position between the drive roller 17 and the rotary plate 6 is adjusted in a radial direction of the rotary plate by placing, i.e. setting, the indicator 16*a* of the feed arm 16 at a desired graduation along scale 20 (see FIG. 4). It will be understood that the rotational speed of the drive roller 17 changes in accordance with the position of the indicator 16*a* along the scale 20.

To hold respective elastic yarns Y between the corresponding feed roller 21*a*, 21*b*, 21*c*, 21*d* and pinch roller 26*a*, 26*b*, 26*c*, 26*d*, the corresponding yarn guide frame 22 is turned counterclockwise in FIG. 3 about the supporting shaft 13 against the elastic force of the coil spring 25 to engage the locking pin 24 with the locking hole 22*b* of the yarn guide frame 22. This separates the feed rollers 21*a*, 21*b*, 21*c* and 21*d* from respective pinch rollers 26*a*, 26*b*, 26*c* and 26*d*, whereby each elastic yarn Y may be passed between them. Thereafter, each of locking pins 24 is disengaged from the locking hole 22*b*, so that each elastic yarn Y is held between the corresponding feed roller 21*a*, 21*b*, 21*c*, 21*d* and pinch roller 26*a*, 26*b*, 26*c*, 26*d*.

Then, when the solenoid 11 is deenergized, the rotary plate 6 is returned by the resilient force of the coil spring 7 to come into contact under pressure with the drive roller 17, and thereby the driving force of the rotary plate 6 is transmitted to the drive roller 17. Thus, the drive shaft 18 is also rotated, so that the feed rollers 21*a*, 21*b*, 21*c* and 21*d* are simultaneously rotated at the same speed. In such a manner, each of the elastic yarn Y is simultaneously fed to the knitting machine at a desired speed by holding between the corresponding feed roller 21*a*, 21*b*, 21*c*, 21*d* and pinch roller 26*a*, 26*b*, 26*c*, 26*d*.

It is to be noted that when the elastic yarn Y is broken during feeding or feeding of the yarn is stopped, the yarn detector 31 is activated to generate a signal of stopping of feed of the yarn. One of the pinch rollers 26*a*, 26*b*, 26*c* and 26*d* may be moved away from the corresponding feed roller 21*a*, 21*b*, 21*c* or 21*d* to temporarily stop feeding of the corresponding elastic yarn Y.

As described above, the present invention is capable of feeding elastic yarns Y at the same speed to attain a desired yarn feeding speed. Moreover, the feed of the elastic yarns Y can be adjusted at the same time, and feeding of some of the elastic yarns Y can be discontinued. Thus, body suits and stretchable knitted goods can be smoothly knitted. In addition, the elastic yarn feeding device of the present invention can be assembled using unitized structures and hence provides excellent advantages such as ease of maintenance.

INDUSTRIAL APPLICABILITY

The elastic yarn feeding device of the present invention may be used for feeding knitting yarns to other types of knitting machine as well as feeding elastic yarns to a circular knitting machine to knit stretchable knitted goods.

I claim:

1. An elastic yarn feeding device including a rotary plate, means for rotating the rotary plate, a drive roller pressed against a surface of the rotary plate for rotation in the tangential direction of the rotary plate by rotation of the rotary plate, means for displacing the drive roller in a radial direction of the rotary plate to vary a revolution of the drive roller, and means for feeding an elastic yarn by the rotation of the drive roller, characterized in that the elastic yarn feeding device comprises: a drive shaft being rotatable together with the drive roller, supporting the drive roller to be axially movable and passing a center axis of the rotary plate to extend in parallel with a surface of the rotary plate; a plurality of feed rollers secured to the drive shaft at intervals; pinch rollers equal in number to the feed rollers and elastically urged against respective feed rollers; and elastic yarn feeding means for feeding the elastic yarn in a state held between each pair of the feed roller and the pinch roller.

2. An elastic yarn feeding devices as recited in claim 1, wherein the elastic yarn feeding means includes: yarn guide frames each supporting each pinch roller; a supporting shaft for supporting the yarn guide frames to turn so that the pinch rollers are moved toward and away from the feed rollers; and springs exerting resilient turning forces to the yarn guide frames so as to press pinch rollers against the feed rollers.

3. An elastic yarn feeding device as recited in claim 2, wherein the yarn guide frames are pivotally connected at one ends thereof to the supporting shaft and rotatably support the pinch rollers at intermediate portions thereof.

4. An elastic yarn feeding device as recited in claim 2, comprising means for holding the yarn guide frames in a state such that pinch rollers are away from feed rollers.

* * * * *

UNITED STATES PATENT AND TRADEMARK OFFICE

CERTIFICATE OF CORRECTION

PATENT NO. : 5,063,756

DATED : November 12, 1991

INVENTOR(S) : TSUTOMU RIKIISHI

It is certified that error appears in the above-identified patent and that said Letters Patent is hereby corrected as shown below:

Title page, after "[22]" insert -- PCT --, change "January 30, 1990" to -- June 2, 1989 --

--[86] PCT No.: PCT/JP89/00561 §371 Date: January 30, 1990 §102(e) Date: January 30, 1990 --

-- [87] PCT Pub. No.: wo 89/12123 PCT Pub. Date: Dec. 14, 1989 --

Signed and Sealed this

Twentieth Day of April, 1993

*Attest:*

*Attesting Officer*

MICHAEL K. KIRK

*Acting Commissioner of Patents and Trademarks*